US006646371B1

(12) United States Patent
Watanabe et al.

(10) Patent No.: US 6,646,371 B1
(45) Date of Patent: Nov. 11, 2003

(54) COLOR CATHODE RAY TUBE HAVING A HIGH-RESOLUTION ELECTRON GUN

(75) Inventors: Kenichi Watanabe, Isumi (JP); Shinichi Kato, Mobara (JP); Hirotsugu Sakamoto, Chiba (JP)

(73) Assignees: Hitachi, Ltd., Tokyo (JP); Hitachi Device Engineering Co., Ltd., Mobara (JP)

( * ) Notice: Subject to any disclaimer, the term of this patent is extended or adjusted under 35 U.S.C. 154(b) by 0 days.

(21) Appl. No.: 09/579,524

(22) Filed: May 26, 2000

(30) Foreign Application Priority Data

May 31, 1999 (JP) ..... 11-151497

(51) Int. Cl.[7] ..... H01J 29/70
(52) U.S. Cl. ..... 313/440
(58) Field of Search ..... 313/477 R, 414, 313/452, 409, 440

(56) References Cited

U.S. PATENT DOCUMENTS

| | | | | |
|---|---|---|---|---|
| 5,382,872 A | | 1/1995 | Kim et al. | |
| 5,606,216 A | | 2/1997 | Uchida et al. | |
| 6,184,617 B1 | | 2/2001 | Choi | |
| 6,225,765 B1 | * | 5/2001 | Yatsu et al. | 315/382 |
| 6,304,026 B1 | * | 10/2001 | Nakamura et al. | 313/414 |

FOREIGN PATENT DOCUMENTS

| | | |
|---|---|---|
| KR | 10-0192456 | 6/1999 |

* cited by examiner

*Primary Examiner*—Sandra O'Shea
*Assistant Examiner*—Sumati Krishnan
(74) *Attorney, Agent, or Firm*—Antonelli, Terry, Stout & Kraus, LLP

(57) ABSTRACT

A color cathode ray tube has an electron gun including a cathode structure for emitting three electron beams, a first electrode serving as a control electrode, a second electrode serving as an accelerating electrode and plural focus electrodes and an anode arranged in the order named, a phosphor screen composed of repeating patterns of three-color phosphor elements, a color selection electrode positioned the electron gun and the phosphor screen. The following inequalities are satisfied. $\{(L+1360\times D-600)/280\}^2+\{(P-0.16)/0.06\}^2\leqq 1$, $L+1360\times D\geqq 600$, and $P\geqq 0.16$, where D (mm) is a horizontal diameter of electron beam apertures in the first electrode, L (mm) is a distance from a midplane between the anode and one of the focus electrodes adjacent to, but spaced from the anode, to a center of the phosphor screen, and P (mm) is a horizontal center-to-center distance between a first phosphor element of a first color of the three-color phosphor elements in a first horizontal row of the repeating patterns and a second phosphor element of the first color which is nearest to the first phosphor element and is in a second horizontal row adjacent to the first horizontal row, at the center of the phosphor screen.

4 Claims, 7 Drawing Sheets

COLOR CATHODE RAY TUBE HAVING A HIGH-RESOLUTION ELECTRON GUN

BACKGROUND OF THE INVENTION

The present invention relates to a cathode ray tube serving as an image display device such as a monitor tube for a terminal of office automation equipment, and in particular to a color cathode ray tube capable of displaying a high definition image.

A color cathode ray tube of this kind, a color cathode ray tube used for a monitor at a terminal of office automation equipment, for example, generally has a vacuum envelope comprised of a panel, a neck and a funnel for connecting the panel and the neck, a phosphor screen comprised of three-color phosphor picture elements coated on an inner surface of the panel, and an electron gun housed in the neck.

The electron gun for the cathode ray tube has three cathodes for generating the three electron beams in a horizontal direction, a first electrode adjacent to the cathodes, a plurality of electrodes located downstream of the first electrode and spaced in the direction of travel of the electron beams for forming a main lens. The three-color phosphor picture elements are fabricated in the form of dots or stripes and are arranged at a predetermined pitch to form the phosphor screen.

FIG. 9 is an enlarged fragmentary front view of a central portion of the phosphor screen of the above-explained color cathode ray tube. Reference numeral 90 denotes dot-shaped phosphor picture elements arranged at a predetermined pitch over the entire inner surface of the panel to form the phosphor screen. Reference numerals 91, 92 and 93 denote red (R) phosphor picture elements, green (G) phosphor picture elements and blue (B) phosphor elements, respectively. A dimension P is a pitch in a horizontal direction of an array of phosphor picture elements of a same color (a horizontal center-to-center distance between a first phosphor picture element of a first color in a first horizontal row of the array of the phosphor picture elements and a second phosphor picture element of the first color which is nearest to the first phosphor picture element of the first color and is in a second horizontal row adjacent to the first horizontal row). A dimension V is a pitch in a vertical direction of the array of the phosphor picture elements of the same color (a vertical center-to-center distance between the phosphor dots in the first and second horizontal rows of the array of phosphor picture elements, respectively).

For a color cathode ray tube employing such a phosphor screen to resolve the fine structure of a display image, it is necessary to reduce the pitches of the array of the phosphor picture elements 90 and thereby to increase the density of the phosphor picture elements 90 in the phosphor screen, and it is especially important to reduce the horizontal pitch P of the array of the phosphor picture elements 90. This is because the three electron beams emitted from the electron gun are arranged in a horizontal direction and consequently, a trio of three phosphor elements of different colors are necessarily arranged in a horizontal direction with respect to an electron beam aperture in a color selection structure, a shadow mask, for example.

This structure imposes a restriction on reduction of the pitches.

The density of the phosphor picture elements 90 is defined in terms of the number N of trios of phosphor elements of three different colors horizontally arranged in two adjacent horizontal rows, as illustrated as the number N of trios comprising . . . an (n−1)st trio, an nth trio, an (n+1)st trio, . . . in FIG. 9.

On the other hand, in order to improve the resolution, it is also necessary to reduce a diameter of an electron beam spot produced by the electron beam striking the phosphor screen as well as the pitches of the array of the phosphor picture elements in the phosphor screen, so that picture detail contained in signals is delineated on the phosphor screen.

To meet such a demand, the conventional horizontal pitch P of about 0.3 mm of the array of the phosphor picture elements is reduced to about 0.22 mm to about 0.24 mm recently and consequently, the number of picture elements capable of being displayed is increased dramatically. Improvements of performance of electron guns reduced the diameter of the electron beam spots from about 0.7 mm to about 0.5 mm.

Especially color cathode ray tubes used for a monitor at a terminal of office automation equipment has been making progress in high information content display with reduction of the pitches of the array of the phosphor picture elements and reduction of the spot diameter produced by the electron beam, as disclosed by the Hitachi Hyoron, vol. 78, December, 1996, for example.

SUMMARY OF THE INVENTION

The color cathode ray tubes used for a monitor at a terminal of office automation equipment or the like must be capable of displaying images of various pixel densities in accordance with deflection frequency or changes of signal formats. The display area is often held constant regardless of the number of pixels forming one picture. Therefore, more is caused by interference between the pitches of the array of the phosphor picture elements and pitches of picture detail contained in signals (video signal frequencies), depending upon the numbers of pixels in vertical and horizontal directions, respectively, and the number of scanning lines, because of the fixed pitches of the array of the phosphor picture elements, and consequently, sharp images were not obtained.

For example, consider that 1300 to 1500 dots are displayed in a horizontal direction on a phosphor screen of a prior art color cathode ray tube having a size of 400 mm in the horizontal direction and about 500 mm in diagonal. In this case the modulation transfer function (the luminance response to an input sine wave signal, hereinafter MTF) is calculated to be approximately equal to or less than 10%.

It is preferable that the MTF response is at least 10% for resolving and delineating detail of letters, characters or patterns on the phosphor screen.

Consequently, it was difficult to display the standard number of display dots of 1600 to 1800 or more required for a display monitor of the above size.

Incidentally, the largest number of resolvable display dots in a horizontal direction divided by a horizontal dimension W of the phosphor screen is 3.25 to 3.75 in the above case, and even the best value for conventional cathode ray tubes is 3.9.

Here, the number of the display dots in the horizontal direction is defined in terms of the number N of trios of phosphor elements of three different colors horizontally arranged in two adjacent horizontal rows, as illustrated as the number N of trios comprising . . . an (n−1)st trio, an nth trio, an (n+1)st trio, . . . in FIG. 9.

It is an object of the present invention to provide a color cathode ray tube capable of providing a sharp image free from occurrence of moire and having resolution sufficiently high to secure the required number of display dots, by eliminating the above problems with the conventional technique.

To accomplish the above objects, in accordance with an embodiment of the present invention, there is provided a color cathode ray tube comprising: a vacuum envelope including a panel, a neck and a funnel for connecting the panel and said neck, an electron gun housed in the neck and including a cathode structure for emitting three electron beams, a first electrode closely spaced from the cathode structure and serving as a control electrode, a second electrode serving as an accelerating electrode and a plurality of focus electrodes and an anode arranged in spaced relationship in a direction of travel of the three electron beams in the order named, a phosphor screen formed on an inner surface of the panel and composed of repeating patterns of three-color phosphor elements facing the electron gun, a color selection electrode positioned in the vacuum envelope between the electron gun and the phosphor screen, and a deflection yoke mounted around the vacuum envelope for scanning the three electron beams on the phosphor screen; the following inequalities being satisfied. $\{(L+1360\times D-600)/280\}^2+\{(P-0.16)/0.06\}^2\leqq 1$, $L+1360\times D\geqq 600$, and $P\geqq 0.16$, where D (mm) is a horizontal diameter of electron beam apertures in the first electrode, L (mm) is a distance from a midplane between the anode and one of the plurality of the focus electrodes adjacent to, but spaced from the anode, to a center of the phosphor screen, and P (mm) is a horizontal center-to-center distance between a first phosphor element of a first color of the three-color phosphor elements in a first horizontal row of the repeating patterns and a second phosphor element of the first color which is nearest to the first phosphor element and is in a second horizontal row adjacent to the first horizontal row, at the center of the phosphor screen.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The embodiments of the present invention will be explained in detail with reference to the drawings.

Figure 1:
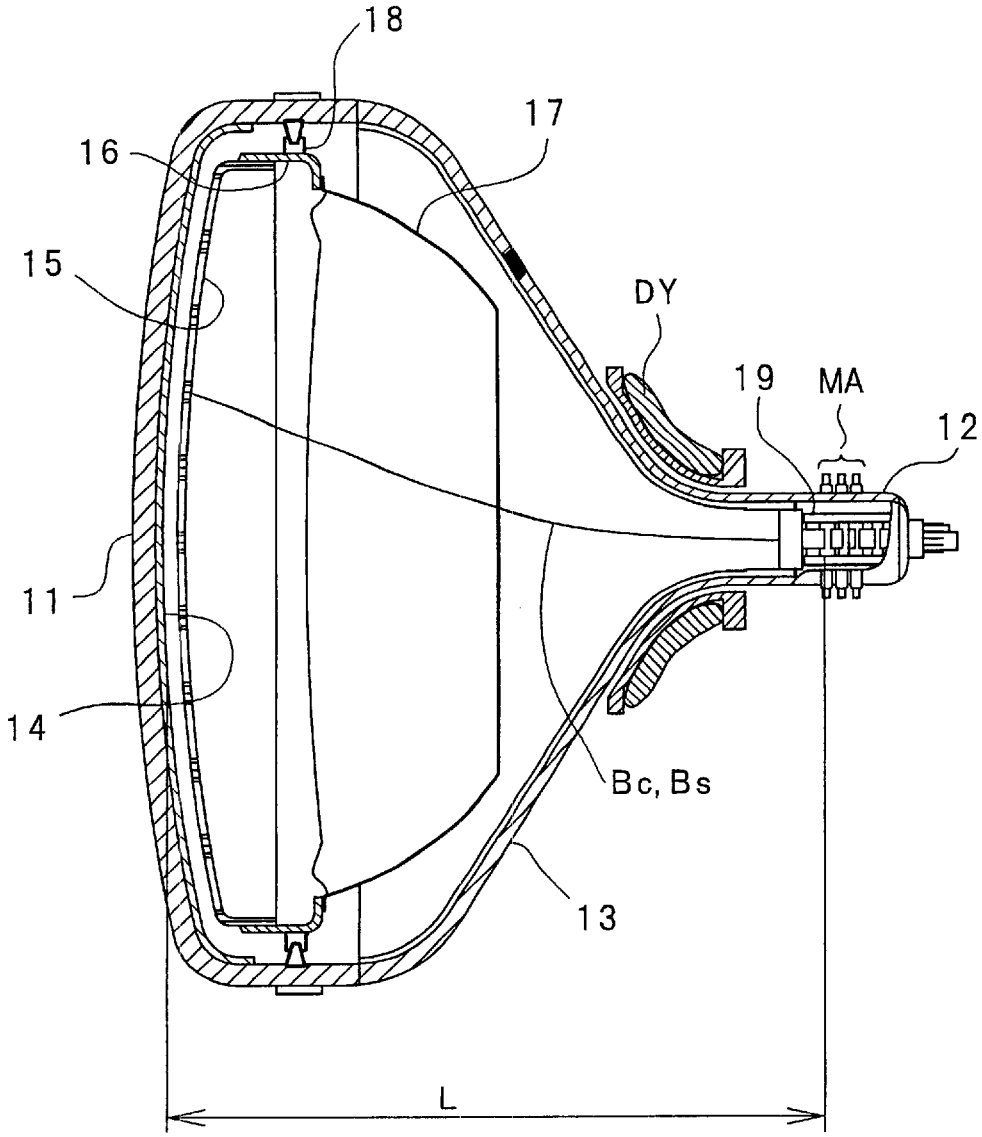
FIG. 1 is a cross-sectional view of a shadow mask type color cathode ray tube in accordance with an embodiment of the present invention.

FIG. 1 is a cross-sectional view of a shadow mask type color cathode ray tube in accordance with an embodiment of the present invention. In FIG. 1, reference numeral 11 denotes a panel, 12 is a neck, 13 is a funnel, 14 is a phosphor screen, 15 is a shadow mask having a multiplicity of electron beam apertures, 16 is a mask frame, 17 is a magnetic shield, 18 is a shadow mask suspension mechanism, 19 is an electron gun for emitting three electron beams, Bc (a center electron beam) and Bs (two side electron beams), DY is a deflection yoke for deflecting the electron beams in horizontal and vertical directions, MA is an external magnetic device for adjustment of color purity and beam convergence, and L is a distance between a final main lens of the electron gun 19 and a center of the phosphor screen 14.

In FIG. 1, a vacuum envelope comprises the panel 11, the funnel 13 and the neck 12, the phosphor screen 14 is formed on the inner surface of the panel 11, the mask frame 16 having the shadow mask 15 and the magnetic shield 17 fixed thereto is suspended within the panel 11 by the shadow mask suspension mechanism 18, the panel 11 is frit-sealed to the funnel 13 by heat-fusing a glass frit, the electron gun 19 is mounted into the neck 12 joined to the funnel 13, and then the vacuum envelope is sealed off after evacuation of the air therefrom.

The three electron beams Bc, Bs from emitted from the electron gun 19 are deflected in horizontal and vertical directions by the deflection DY mounted on the transition region between the neck 12 and the funnel 13, and are transmitted through electron beam apertures in the shadow mask 15 serving as a color selection electrode to strike the phosphor picture elements of their intended colors forming the phosphor screen 14 and form a color image. The pitches of the array of the phosphor picture elements in the phosphor screen 14 are chosen according to a specification described subsequently.

Figure 2A:
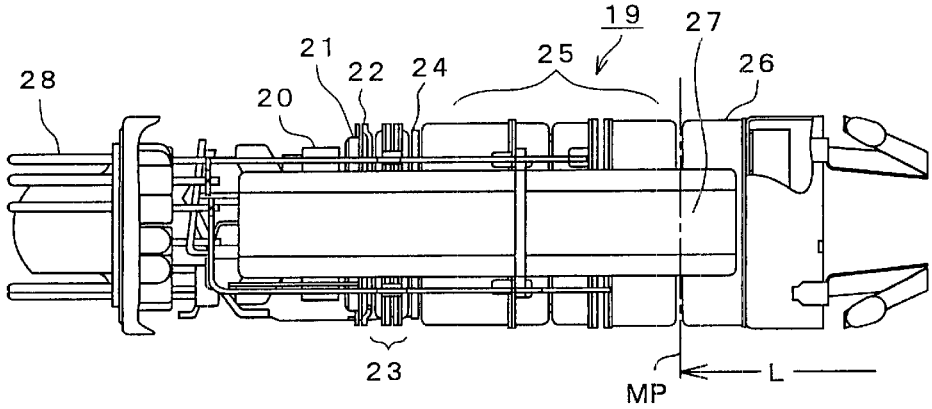
FIG. 2A is a side view of a structural example of an electron gun used for a color cathode ray tube of the present invention.
Figure 2B:
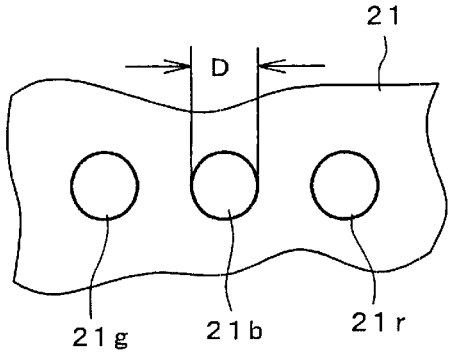
FIG. 2B is an enlarged plan view of an essential part thereof.

FIGS. 2A and 2B are illustrations of a structural example of an electron gun 19 used for a color cathode ray tube of the present invention, FIGS. 2A is a side view thereof, and FIG. 2B is an enlarged fragmentary front view of a first electrode 21 of the electron gun.

In FIGS. 2A and 2B, reference numeral 20 denotes a cathode structure, 21 is the first electrode, 21*b* is a center electron beam aperture in the first electrode 21, 21*g* and 21*r* are side electron beam apertures in the first electrode 21, respectively, a dimension D is a diameter in a horizontal direction of the electron beam apertures 21*b*, 21*g* and 21*r*, and is chosen according to a specification described subsequently. Reference numeral 22 denotes a second electrode, 23 is a third electrode, 24 is a fourth electrode, 25 is a fifth electrode, 26 is a sixth electrode, 27 are beading glasses (only one of which is shown), and 28 are stem pins.

The electron beam apertures 21*b*, 21*g* and 21*r* can also be square, rectangular or rhombic.

In FIG. 2A, the cathode structure 20, the first electrode (G1) 21, the second electrode (G2) 22, the third electrode (G3) 23, the fourth electrode (G4) 24, the fifth electrode (G5) 25 and the sixth electrode (G6) 26 are coaxially fixed on a pair of beading glasses 27.

In FIG. 1, a dimension L is a distance from a main lens formed between the fifth electrode 25 and the sixth electrode (an anode) 26 (see FIG. 2A also) to the center of the phosphor screen 14, that is, a distance from a midplane MP (see FIG. 2A) between the fifth electrode 25 and the sixth electrode (the anode) 26 to the center of the phosphor screen 14, and is chosen in accordance with a specification described subsequently. The distance from the midplane between an anode and an electrode adjacent to, but spaced from the anode for forming a final main lens therebetween to the center of the phosphor screen 14 is hereinafter referred to as a lens-screen distance L.

Electron beams emitted from the cathode structure 20 are appropriately accelerated and focused by the first electrode 21, the second electrode 22, the third electrode 23, the fourth electrode 24, the fifth electrode 25 and the sixth electrode 26, and are projected toward the phosphor screen from the sixth electrode 26. The stem pins 28 serve as terminals for applying required voltages or video signals to the respective electrodes forming the electron gun.

The conditions for the computer simulations are as follows:

- a voltage applied to the sixth electrode (the anode)=28 kV,
- a voltage applied to the fifth electrode=26 to 28% of the anode voltage,
- a voltage applied to the second grid electrode=600 V,
- a distance from a cathode side of the first electrode (G1) to a midplane between the fifth and sixth electrodes=35 mm, and
- a lens diameter of an equal-diameter two-cylinder lens equivalent having substantially the same amount of aberration as a lens used for the simulation=8.5 mm.

Figure 3:
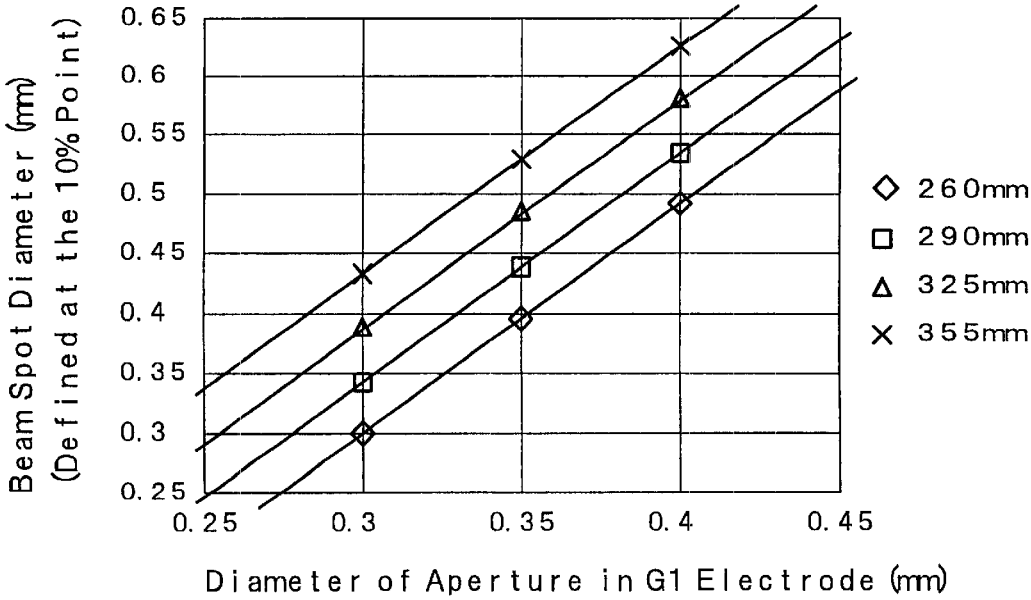
FIG. 3 is a graph showing a relationship between electron beam apertures in the G1 electrode and the diameter of electron beam spots for explaining the present invention.

FIG. 3 is a graph showing a relationship between diameters (mm) of electron beam spots on the phosphor screen and horizontal diameters D (mm) of an electron beam aperture in the first electrode (G1) of the electron gun with the lens-screen distance L (mm) as a parameter, where L are 260 mm for a 36-cm diagonal screen, 290 mm for a 41-cm diagonal screen, 325 mm for a 46-cm diagonal screen, and 355 mm for a 51-cm diagonal screen, of color cathode ray tubes of a 90° deflection angle, for the purpose of explaining the present invention. As is apparent from FIG. 3, the smaller the lens-screen distance L (or the diagonal screen size) and the smaller the diameter of the electron beam aperture in the first grid aperture, the smaller the diameter of the electron beam spot on the phosphor screen can be made.

The electron beams are emitted from the cathodes, pass through the first electrode (G1) serving as a control electrode and the second electrode serving as an accelerating electrode, and are accelerated as far as the main lens formed by the fifth electrode 25 and the sixth electrode 26 for focusing the electron beams, then the electron beams are subjected to the strong acceleration and strong focusing action by the main lens, thereby produce electron beam spots on the phosphor screen.

Two major factors in determining the diameter of an electron beam spot are one due to space charge effects and thermal initial velocity spread of electrons and another due to spherical aberration in the main lens.

FIG. 3 shows that reducing the diameter of an electron beam aperture in the first electrode (G1) 21, and thereby reducing the size of object to be imaged on the screen is an effective way, and that the influences of the space charge effects and the thermal initial velocity spread of electrons on the diameter of the electron beam spot depend mainly upon the lens-screen distance L and the diameter of the electron beam aperture in the first electrode (G1) 21.

Figure 4A:
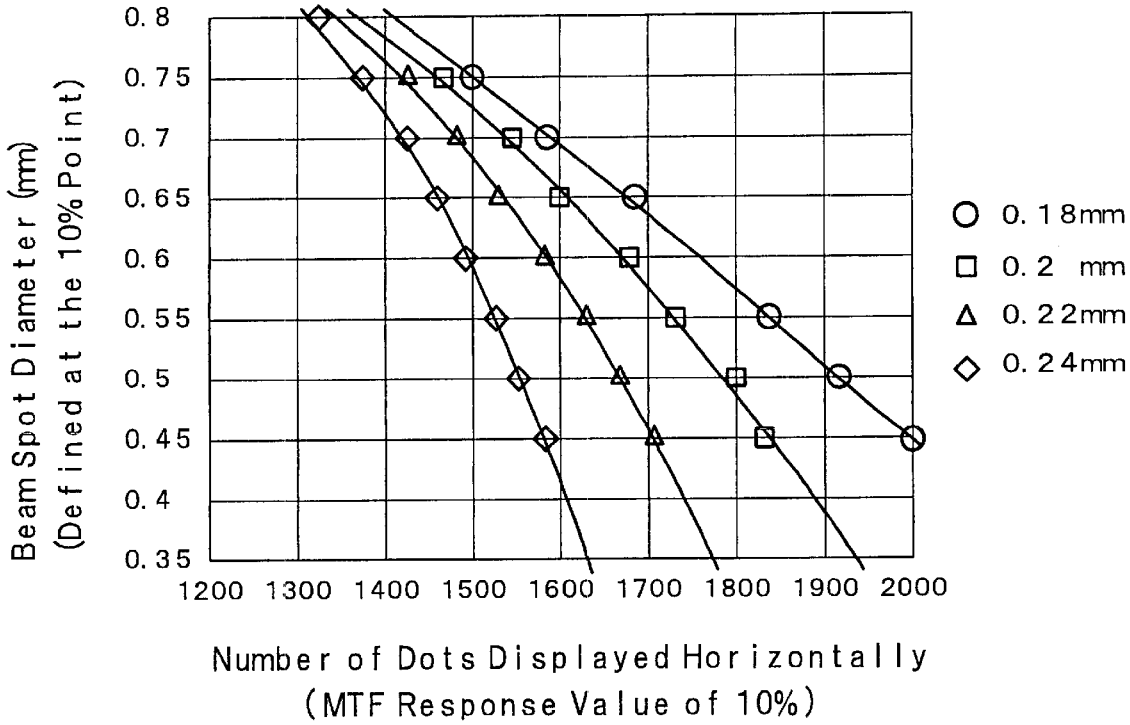
FIGS. 4A and 4B are graphs showing a calculated relationship between diameters (mm) of electron beam spots on the phosphor screen and the number of dots capable of being displayed horizontally on the phosphor screen and ensuring the MTF response value of 10%, with a horizontal phosphor dot pitch as a parameter, for color cathode ray tubes having 51-cm diagonal and 41-cm diagonal screen sizes, respectively.
Figure 4B:
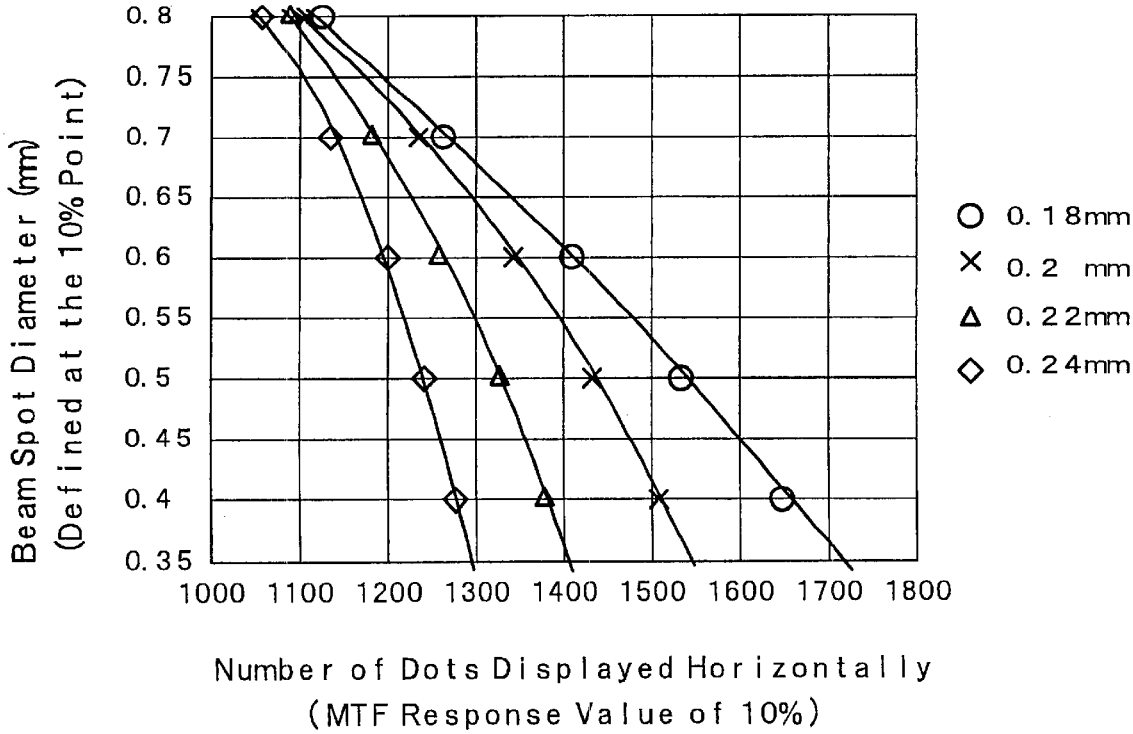

FIGS. 4A and 4B are graphs showing the calculated relationship between diameters (mm) of electron beam spots on the phosphor screen and the number of dots capable of being displayed horizontally on the phosphor screen and ensuring the MTF response value of 10%, with a horizontal phosphor dot pitch as a parameter, for a color cathode ray tube having a 355-mm lens-screen distance L and a usable 51-cm diagonal screen and a color cathode ray tube having a 290-mm lens-screen distance L and a usable 41-cm diagonal screen, respectively, where the horizontal phosphor dot pitches at the center of the phosphor screen as parameters are 0.18 mm, 0.20 mm, 0.22 mm and 0.24 mm.

Figure 9:
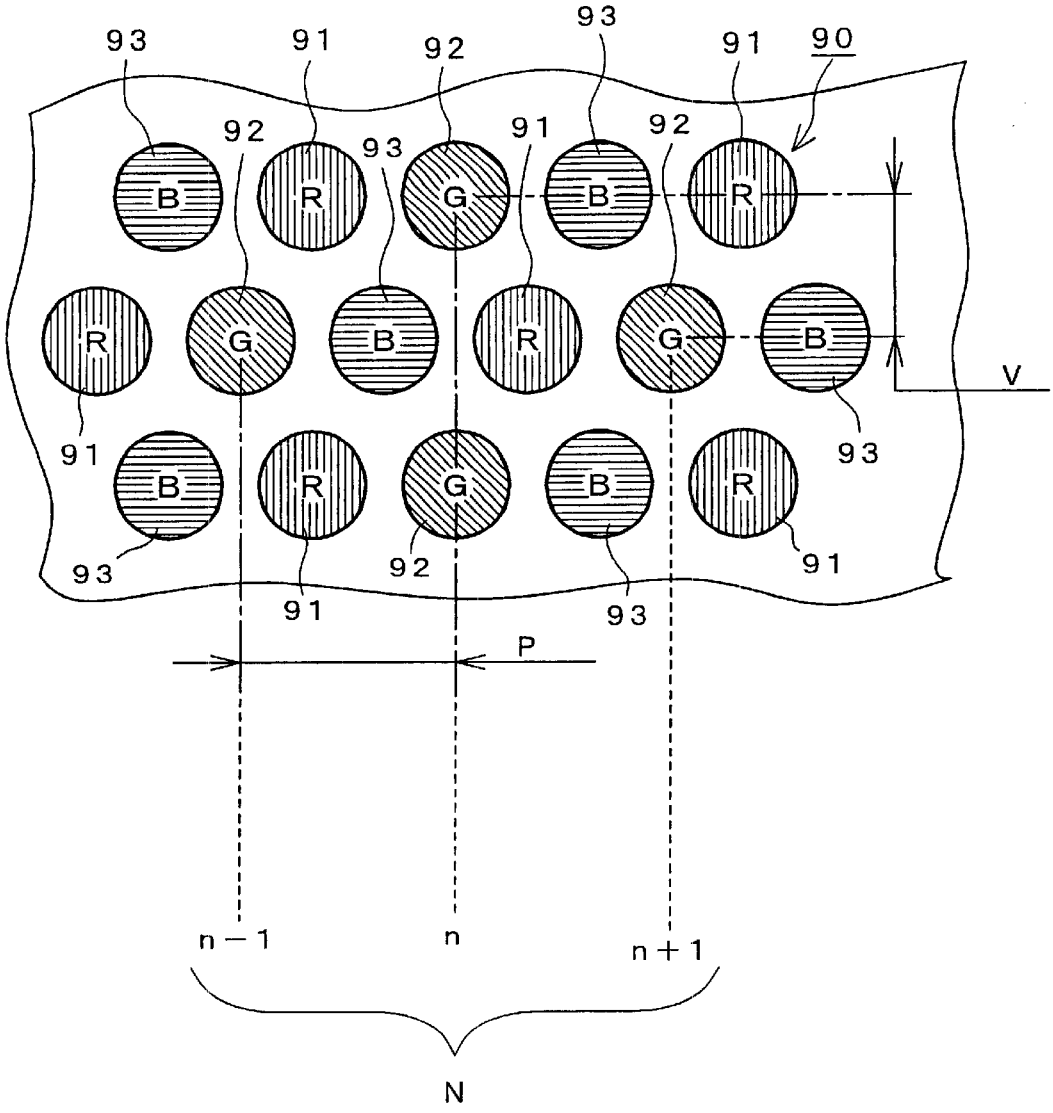
FIG. 9 is an enlarged fragmentary front view of a central portion of the phosphor screen of a color cathode ray tube.

Here, the number of the display dots in the horizontal direction is defined in terms of the number N of trios of phosphor elements of three different colors horizontally arranged in two adjacent horizontal rows, as illustrated as the number N of trios comprising . . . an (n−1)st trio, an nth trio, an (n+1)st trio, . . . in FIG. 9.

Figure 5A:
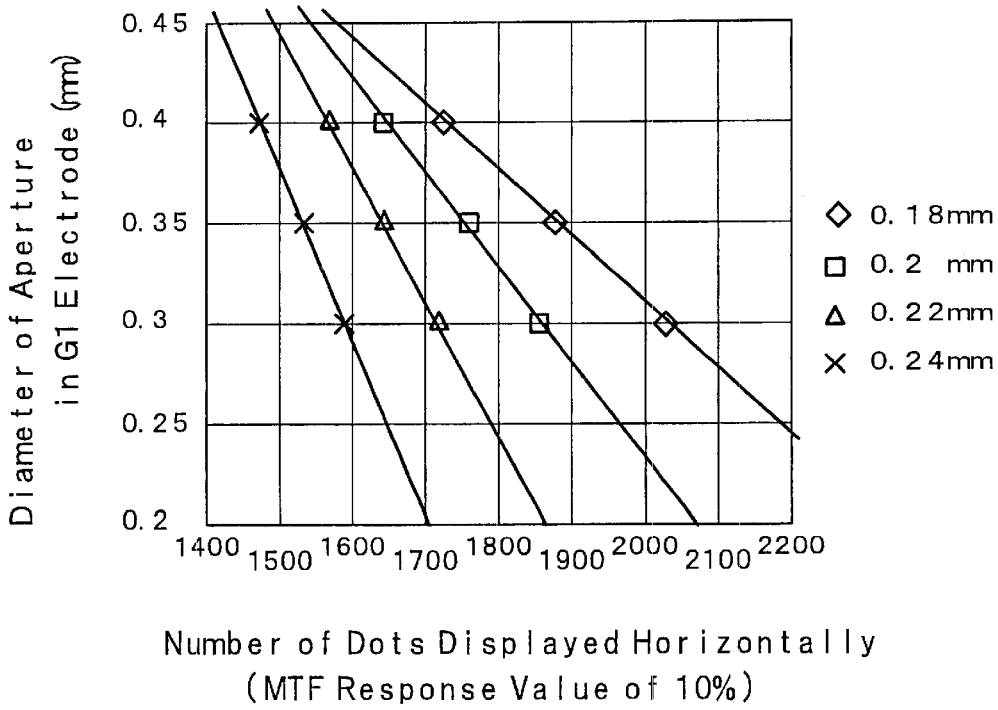
FIGS. 5A and 5B are graphs showing a calculated relationship between horizontal diameters D (mm) of an electron beam aperture in the first electrode (G1) of an electron gun on the phosphor screen and the number of dots capable of being displayed horizontally on the phosphor screen and ensuring the MTF response value of 10%, with a horizontal phosphor dot pitch as a parameter, for color cathode ray tubes having 51-cm diagonal and 41-cm diagonal screen sizes, respectively.
Figure 5B:
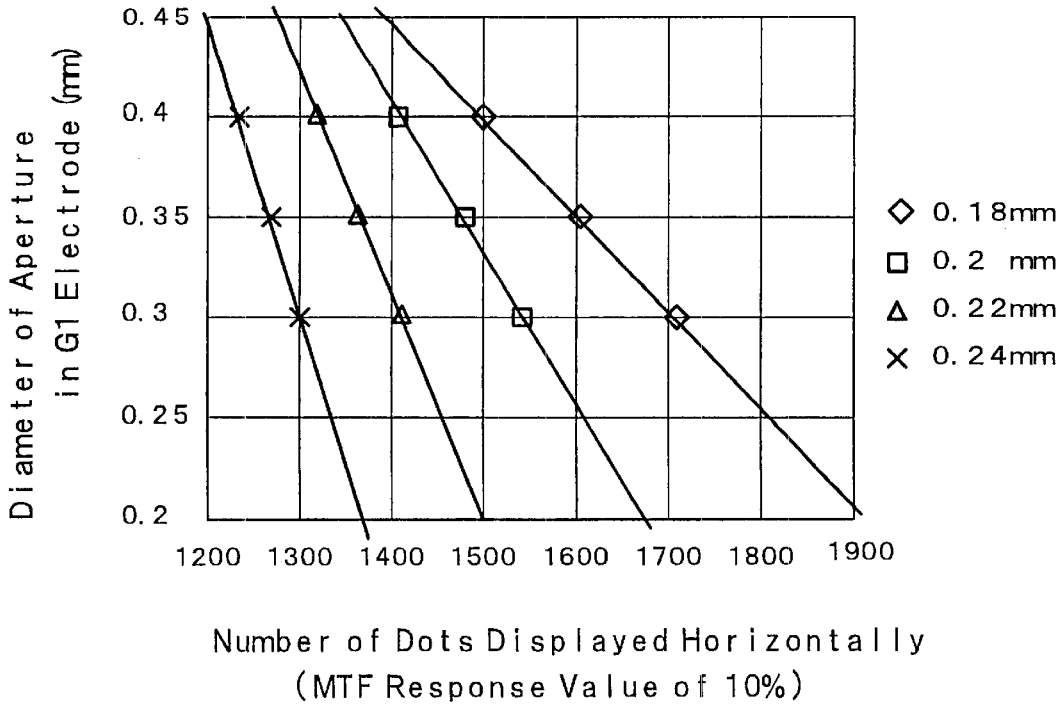

FIGS. 5A and 5B are graphs showing the calculated relationship between horizontal diameters D (mm) of an electron beam aperture in the first electrode (G1), which is hereinafter referred to as G1 aperture diameters, of an electron gun and the number of dots capable of being displayed horizontally on the phosphor screen and ensuring the MTF response value of 10%, with a horizontal phosphor dot pitch as a parameter, for a color cathode ray tube having a 355-mm lens-screen distance L and a usable 51-cm diagonal screen and a color cathode ray tube having a 290-mm lens-screen distance L and a usable 41-cm diagonal screen, respectively, where the horizontal phosphor dot pitches at the center of the phosphor screen used as parameters are 0.18 mm, 0.20 mm, 0.22 mm and 0.24 mm.

Here, the number of the display dots in the horizontal direction is defined in terms of the number N of trios of phosphor elements of three different colors horizontally arranged in two adjacent horizontal rows, as illustrated as the number N of trios comprising . . . an (n−1)st trio, an nth trio, an (n+1)st trio, . . . in FIG. 9.

The diameter of an electron beam spot is reduced as the lens-screen distance is reduced while the G1 aperture diameter is held constant.

Figure 6:
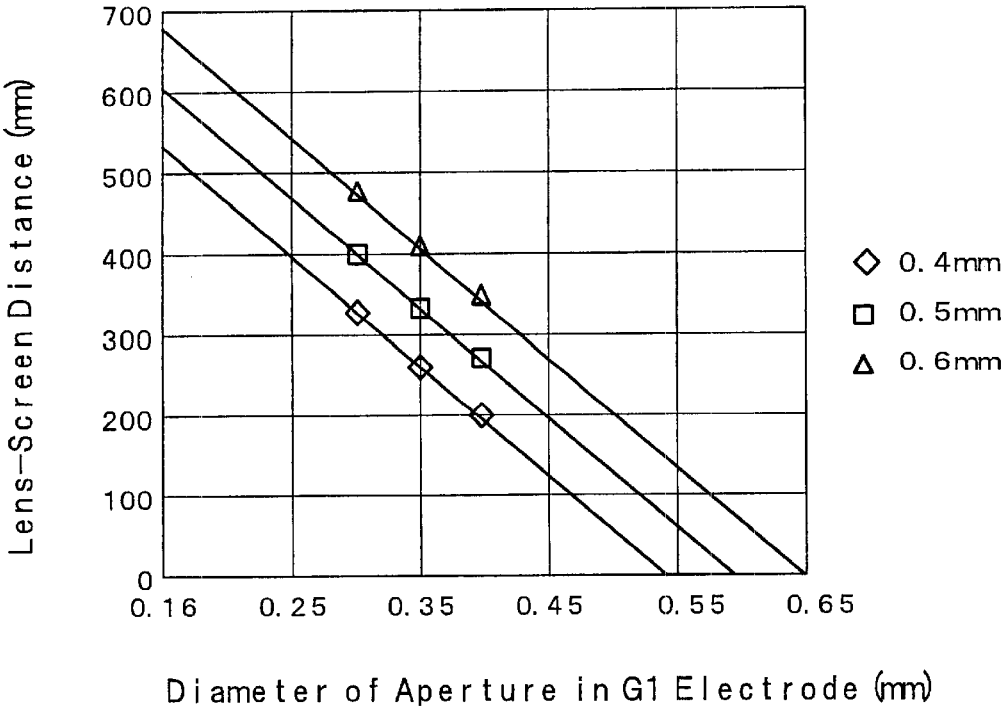
FIG. 6 is a graph showing a relationship between a G1 aperture diameter D and a lens-screen distance L with an electron beam spot as a parameter.

It was found by computer simulation that, for a given required diameter of an electron beam spot, there is a specific relationship between a G1 aperture diameter D and a lens-screen distance L. FIG. 6 shows this relationship with an electron beam spot as a parameter, in which the electron beam spots used as parameters are 0.4 mm, 0.5 mm and 0.6 mm.

As is evident from FIG. 6, G1 aperture diameters D and lens-screen distances L are linearly related, and the following equation is obtained.

1360×the $G1$ aperture diameter (mm)+the lens-screen distance (mm)=constant.

In the equation, the value 1360 corresponds to a slope of lines in FIG. 6.

Based upon data of FIGS. 5A, 5B and 6, FIG. 7 is a graph showing a relationship between a value of {1360×the G1 aperture diameter D (mm)+the lens-screen distance L (mm)} and {the number of dots capable of being resolved in a horizontal direction and ensuring the MTF response value of 10%} divided by the horizontal width W of the phosphor screen, with a horizontal phosphor dot pitch as a parameter, in which the horizontal phosphor dot pitches at the center of the phosphor screen used as parameters are 0.18 mm, 0.20 mm, 0.22 mm and 0.24 mm.

Usually high-definition color cathode ray tubes having 46-cm and 51-cm diagonal screens are required to resolve at least 1600 dots and 1800 dots in a horizontal direction on the phosphor screens, respectively. These requirements correspond to the resolution of at least 4.4 dots/mm in the horizontal direction on the phosphor screen.

Here, the number of the display dots in the horizontal direction is defined in terms of the number N of trios of phosphor elements of three different colors horizontally arranged in two adjacent horizontal rows, as illustrated as the number N of trios comprising . . . an (n−1)st trio, an nth trio, an (n+1)st trio, . . . in FIG. 9.

Figure 7:
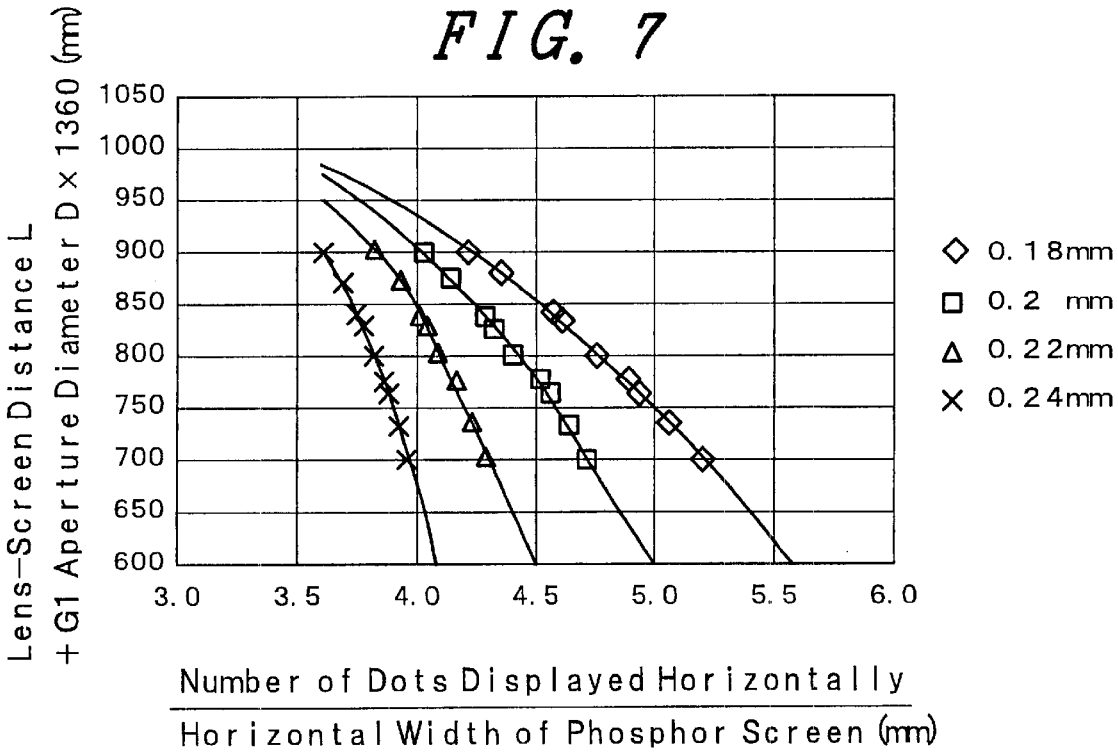
FIG. 7 is a graph showing a relationship between a value of {1360×the G1 aperture diameter D(mm)+the lens-screen distance L (mm)} and {the number of dots capable of being resolved in a horizontal direction and ensuring the MTF response value of 10%} divided by the horizontal width W of the phosphor screen, with a phosphor dot pitch as a parameter.
Figure 8:
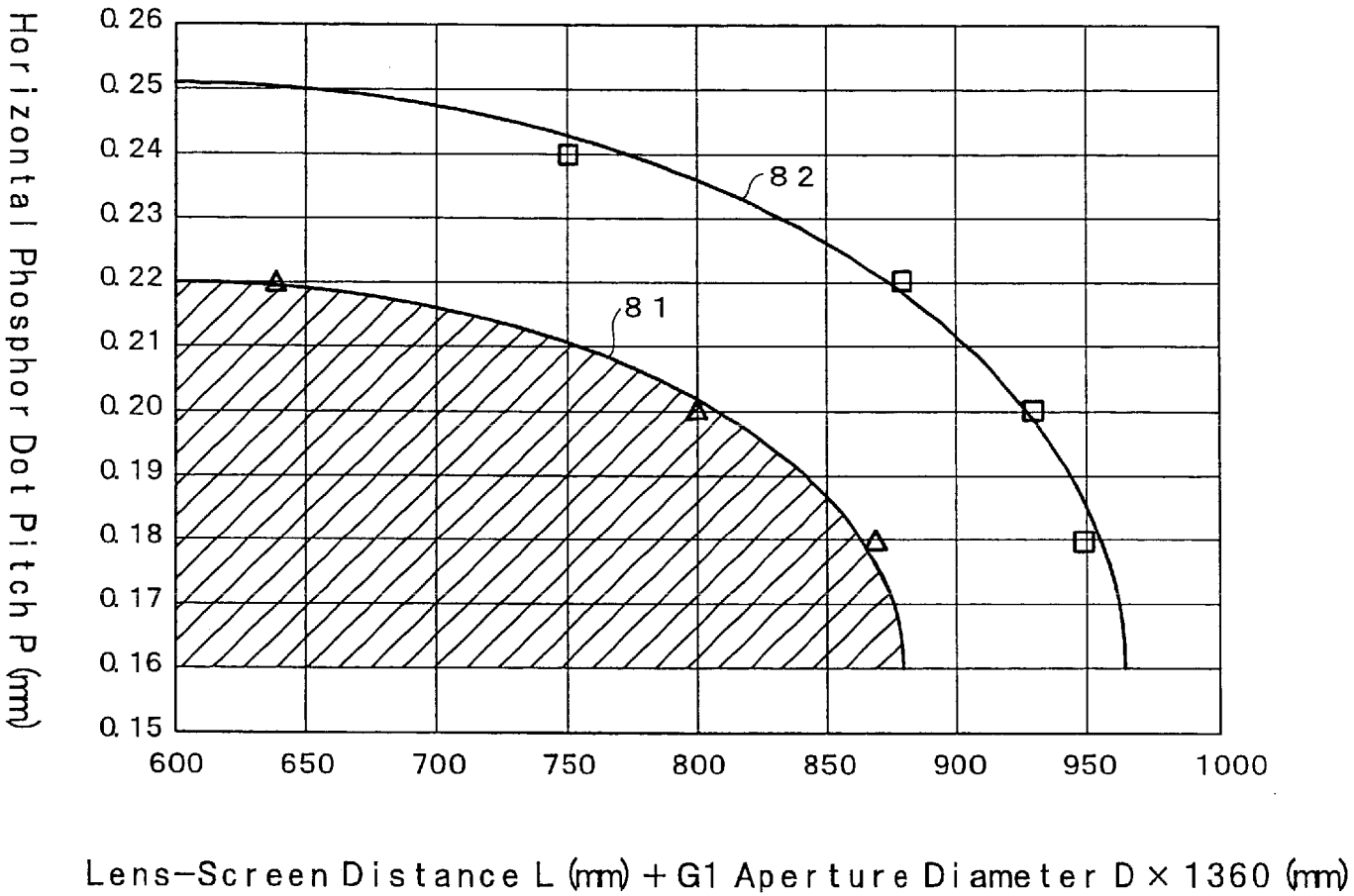
FIG. 8 is a graph showing a relationship between a value of {the lens-screen distance L (mm)+1360×the G1 aperture diameter D (mm)} and horizontal phosphor dot pitches P(mm) corresponding to a region where the number of resolvable dots/mm is equal to or more than 4.4 dots/mm of FIG. 7.

In FIG. 8, a hatched area enclosed by a curve 81 corresponds to the region where the number of resolvable dots/mm is equal to or more than 4.4 dots/mm of FIG. 7, indicating a relationship between a value of {the lens-screen distance L (mm)+1360×the G1 aperture diameter D (mm)} and horizontal phosphor dot pitches P(mm).

The hatched area enclosed by the curve 81 is expressed by $$\{(L+1360\times D-600)/280\}^2+\{(P-0.16)/0.06\}^2\leqq 1 \text{ where } L+1360\times D\geqq 600 \text{ and } P\geqq 0.16.$$

It is preferable that the horizontal diameter D (mm) of an electron beam aperture in the first electrode (G1) is at least 0.25 mm for ease of fabrication, and it is also preferable that the lens-screen distance L is larger than 260 mm when deflection angle and avoidance of neck shadow are considered. Incidentally, in FIG. 8, a curve 82 indicates a relationship between a value of {the lens-screen distance L (mm)+1360×the G1 aperture diameter D(mm)} and horizontal phosphor dot itches P(mm) for a conventional color cathode ray tube.

Next, concrete examples of color cathode ray tubes in accordance with the present invention will be explained.

EXAMPLE 1

Consider a case where 2.5 million pixels (1800 dots in horizontal direction) are displayed on a usable 51-cm diagonal phosphor screen (a horizontal width W of the phosphor screen=408 mm) of a color cathode ray tube.

When the horizontal phosphor dot pitch P at the center of the phosphor screen and the lens-screen distance L are selected to be 0.2 mm and 355 mm, respectively, the diameter of an electron beam spot for ensuring the MTF response of 10% is 0.48 mm according to FIG. 4A and then the G1 aperture diameter D for providing this electron beam spot diameter at the center of the screen is equal to or smaller than 0.33 mm according to FIG. 5A. For these values, the lens-screen distance L+1360×the G1 aperture diameter D becomes 803 mm.

The above obtained dimensions lie in the hatched area of FIG. 8, and the number of resolvable dots in the horizontal direction divided by the horizontal width W of the phosphor screen becomes 4.41 dots/mm and satisfies the above-explained resolution requirement of at least 4.4 dots/mm in the horizontal direction on the phosphor screen.

EXAMPLE 2

Consider a case where 2.5 million pixels (1800 dots in horizontal direction) are displayed on a usable 51-cm diagonal phosphor screen (a horizontal width W of the phosphor screen 408 mm) of a color cathode ray tube.

When the horizontal phosphor dot pitch P at the center of the phosphor screen, the lens-screen distance L and the G1 aperture diameter D are selected to be 0.2 mm, 314 mm and 0.35 mm, the lens-screen distance L+1360×the G1 aperture diameter D becomes 790 mm.

The above obtained dimensions lie in the hatched area of FIG. 8, and the number of resolvable dots in the horizontal direction divided by the horizontal width W of the phosphor screen becomes 4.41 dots/mm and satisfies the above-explained resolution requirement of at least 4.4 dots/mm in the horizontal direction on the phosphor screen.

EXAMPLE 3

Consider a case where 2.5 million pixels (1800 dots in a horizontal direction) are displayed on a usable 51-cm diagonal phosphor screen (a horizontal width W of the phosphor screen=408 mm) of a color cathode ray tube.

When the horizontal phosphor dot pitch P at the center of the phosphor screen, the lens-screen distance L and the G1 aperture diameter D are selected to be 0.21 mm, 284 mm and 0.30 mm, the lens-screen distance L+1360×the G1 aperture diameter D becomes 692 mm.

The above obtained dimensions lie in the hatched area of FIG. 8, and the number of resolvable dots in the horizontal direction divided by the horizontal width W of the phosphor screen becomes 4.41 dots/mm and satisfies the above-explained resolution requirement of at least 4.4 dots/mm in the horizontal direction on the phosphor screen.

EXAMPLE 4

Consider a case where 2.0 million pixels (1600 dots in a horizontal direction) are displayed on a usable 41-cm diagonal phosphor screen (a horizontal width W of the phosphor screen=328 mm) of a color cathode ray tube.

When the horizontal phosphor dot pitch P at the center of the phosphor screen and the lens-screen distance L are selected to be 0.18 mm and 280 mm, respectively, the diameter of an electron beam spot for ensuring the MTF response of 10% is 0.44 mm according to FIG. 4B and then the G1 aperture diameter D for providing this electron beam spot diameter at the center of the screen is equal to or smaller than 0.35 mm according to FIG. 5B. For these values, the lens-screen distance L+1360×the G1 aperture diameter D becomes 756 mm.

The above obtained dimensions lie in the hatched area of FIG. 8, and the number of resolvable dots in the horizontal direction divided by the horizontal width W of the phosphor screen becomes 4.88 dots/mm and satisfies the above-explained resolution requirement of at least 4.4 dots/mm in the horizontal direction on the phosphor screen.

The above concrete examples have been explained in connection with the usable 51-cm and 41-cm diagonal phosphor screen sizes, and it is needless to say that the present invention is also applicable to color cathode ray tubes having other usable diagonal phosphor screen sizes.

The present invention is not limited to the above embodiments, but changes and modifications may be made without departing from the spirit and scope of the invention as defined in the appended claims.

As explained above, the present invention provides a color cathode ray tube capable of displaying the desired number of dots and free from occurrence of moire to produce a high-resolution and sharp image by specifying a relationship between the G1 aperture diameter D, the lens-screen distance L and the horizontal phosphor dot pitch P on the screen.

What is claimed is:

1. A color cathode ray tube comprising:

a vacuum envelope including a panel, a neck and a funnel for connecting said panel and said neck, an electron gun housed in said neck and including a cathode structure for emitting three electron beams, a first electrode closely spaced from said cathode structure and serving as a control electrode, a second electrode serving as an accelerating electrode and a plurality of focus electrodes and an anode arranged in spaced relationship in a direction of travel of said three electron beams in the order named, a phosphor screen formed on an inner surface of said panel and composed of repeating patterns of three-color phosphor elements facing said electron gun, a color selection electrode positioned in said vacuum envelope between said electron gun and said phosphor screen, and a deflection yoke mounted around said vacuum envelope for scanning said three electron beams on said phosphor screen;

the following inequalities being satisfied, $$\{(L+1360\times D-600)/280\}^2+\{(P-0.16)/0.06\}^2 \leqq 1,\ L+1360\times D \geqq 600, \text{ and}$$

$$P \geqq 0.16,$$

where D (mm) is a horizontal diameter of electron beam apertures in said first electrode, L (mm) is a distance from a midplane between said anode and one of said plurality of said focus electrodes adjacent to, but spaced from said anode, to a center of said phosphor screen, and P (mm) is a horizontal center-to-center distance between a first phosphor element of a first color of said three-color phosphor elements in a first horizontal row of said repeating patterns and a second phosphor element of said first color which is nearest to said first phosphor element and is in a second horizontal row adjacent to said first horizontal row, at said center of said phosphor screen.

2. A color cathode ray tube according to claim 1, wherein L≧260 mm and D≧0.25 mm.

3. A color cathode ray tube according to claim 1, wherein said electron beams resolve at least 4.4 dots/mm in a horizontal direction at said center of said phosphor screen, where the number of said dots in the horizontal direction is defined in terms of the number of trios of said three-color phosphor elements horizontally arranged in two adjacent horizontal rows.

4. A color cathode ray tube according to claim 2, wherein said electron beams resolve at least 4.4 dots/mm in a horizontal direction at said center of said phosphor screen, where the number of said dots in the horizontal direction is defined in terms of the number of trios of said three-color phosphor elements horizontally arranged in two adjacent horizontal rows.

* * * * *